US008128299B2

(12) United States Patent
Huang

(10) Patent No.: US 8,128,299 B2
(45) Date of Patent: Mar. 6, 2012

(54) NAIL ENAMEL APPLICATOR HAVING AN AIR-TIGHT EFFECT

(75) Inventor: Tao-Tien Huang, Changhua Hsien (TW)

(73) Assignee: Victoria Cosmetic Co., Ltd., Changhua Hsien (TW)

( * ) Notice: Subject to any disclaimer, the term of this patent is extended or adjusted under 35 U.S.C. 154(b) by 394 days.

(21) Appl. No.: 12/468,202

(22) Filed: May 19, 2009

(65) Prior Publication Data

US 2010/0296857 A1 Nov. 25, 2010

(51) Int. Cl.
*B05C 1/00* (2006.01)

(52) U.S. Cl. ..... 401/17; 401/16; 401/126; 401/130; 132/73; 132/74.5

(58) Field of Classification Search ..... 401/16, 401/17, 122, 126, 130, 195; 132/73, 74.5, 132/75

See application file for complete search history.

(56) References Cited

U.S. PATENT DOCUMENTS

| | | | | |
|---|---|---|---|---|
| 6,059,474 | A * | 5/2000 | Huang | 401/16 |
| 6,065,477 | A * | 5/2000 | Doo | 132/73 |
| 6,776,548 | B2 * | 8/2004 | Gardner et al. | 401/16 |
| 7,563,046 | B2 * | 7/2009 | Patel | 401/130 |

* cited by examiner

*Primary Examiner* — Steven J Ganey
(74) *Attorney, Agent, or Firm* — Alan Kamrath; Kamrath IP Lawfirm, PA

(57) ABSTRACT

A nail enamel applicator includes a resilient tube, an adaptor mounted on the top portion of the tube and having an upper end provided with a clamping hole and a guide portion, a pen head mounted in the adaptor and having an upper end provided with a tip extending through the guide portion into the clamping hole, a top cap mounted on the adaptor to cover the tip, and a brush having an upper end provided with a pipe inserted into an open lower end of the pen head and a lower end provided with multiple bristles. Thus, the tip is clamped by the clamping hole so that the clamping hole is sealed closely by the tip without producing a gap between the tip and the clamping hole to prevent air from being introduced into the tube.

10 Claims, 8 Drawing Sheets

NAIL ENAMEL APPLICATOR HAVING AN AIR-TIGHT EFFECT

BACKGROUND OF THE INVENTION

1. Field of the Invention

The present invention relates to an applicator and, more particularly, to a nail enamel applicator to apply a nail enamel to a user's nails.

2. Description of the Related Art

A conventional nail enamel applicator in accordance with the prior art shown in FIG. 8 comprises a resilient tube 30 having an open top portion 31, a hollow adaptor 41 having an open lower end 411 mounted on the top portion 31 of the tube 30 and an upper end provided with a through hole 413, a hollow pen head 44 mounted in the adaptor 41 and having an upper end provided with a hollow tip 442 extending through and protruding outwardly from the through hole 413 of the adaptor 41, a top cap 43 mounted on the adaptor 41 to cover the tip 442 of the pen head 44, and a brush 42 mounted in the adaptor 41 and having an upper end provided with a hollow pipe 422 inserted into an open lower end 443 of the pen head 44 and a lower end provided with multiple bristles 426 extending into the tube 30.

The tube 30 has an inside containing a nail enamel therein. The top portion 31 of the tube 30 has an outer wall provided with an outer thread 32. The adaptor 41 has an inner wall provided with a stop shoulder 414 a first inner thread 412 and a second inner thread 415. The first inner thread 412 of the adaptor 41 is screwed onto the outer thread 32 of the tube 30. The tip 442 of the pen head 44 is connected to an inside of the pen head 44. The open lower end 443 of the pen head 44 is connected to the tip 442 of the pen head 44 and has an outer wall provided with a stop flange 441 abutting the stop shoulder 414 of the adaptor 41 to locate the pen head 44 in the adaptor 41. The top cap 43 has an open lower end mounted on the adaptor 41. The top cap 43 has a top portion having an inner side provided with a sealing aperture 431 to allow insertion of the tip 442 of the pen head 44. The upper end of the brush 42 is further provided with a ring member 421 abutting the stop flange 441 of the pen head 44. The ring member 421 of the brush 42 is provided with an inner thread screwed into the second inner thread 415 of the adaptor 41. The upper end of the brush 42 is further provided with a ring-shaped plug 423 inserted into the top portion 31 of the tube 30. The pipe 422 of the brush 42 has an inner portion provided with a conduit 425 connected to the tip 442 of the pen head 44. The brush 42 has a peripheral wall provided with a plurality of connecting holes 424 connected to the conduit 425 of the pipe 422.

In operation, after the adaptor 41 is removed from the top portion 31 of the tube 30, the brush 42 is detached from the top portion 31 of the tube 30, so that the nail enamel on the bristles 426 of the brush 42 can be used to paint a user's nails in a planar manner. Alternatively, after the top cap 43 is removed from the adaptor 41, the tip 442 of the pen head 44 is exposed outwardly from the through hole 413 of the adaptor 41. In such a manner, when the tube 30 is squeezed by the user, the nail enamel in the tube 30 is forced to pass through the connecting holes 424 of the brush 42, the conduit 425 of the pipe 422 and the inside of the pen head 44 into the tip 442 of the pen head 44 and is sprayed outwardly from the tip 442 of the pen head 44 to paint the user's nails in a linear manner.

However, the tip 442 of the pen head 44 is loosely fitted in the through hole 413 of the adaptor 41 to define a gap between the tip 442 of the pen head 44 and the through hole 413 of the adaptor 41 so that air is easily introduced through the gap into the tube 30, thereby easily solidifying and decreasing the quality of the nail enamel in the tube 30. In addition, the sealing aperture 431 of the top cap 43 has a smaller size so that when the top cap 43 is mounted on the adaptor 41 to cover the tip 442 of the pen head 44, the tip 442 of the pen head 44 is not easily inserted into the sealing aperture 431 of the top cap 43. Further, the tip 442 of the pen head 44 is easily distorted or deformed by the top cap 43 during assembly.

BRIEF SUMMARY OF THE INVENTION

In accordance with the present invention, there is provided a nail enamel applicator, comprising a resilient tube having an open top portion, a hollow adaptor having an open lower end mounted on the top portion of the tube and an upper end provided with a clamping hole and a guide portion, a hollow pen head mounted in the adaptor and having an upper end provided with a hollow tip extending through the guide portion into the clamping hole of the adaptor and protruding outwardly from the clamping hole of the adaptor, a top cap mounted on the adaptor to cover the tip of the pen head, and a brush mounted in the adaptor and having an upper end provided with a hollow pipe inserted into an open lower end of the pen head and a lower end provided with multiple bristles extending into the tube. The tip of the pen head has a diameter greater than that of the clamping hole of the adaptor so that the tip of the pen head presses the clamping hole of the adaptor closely to seal the clamping hole of the adaptor.

The primary objective of the present invention is to provide a nail enamel applicator having an air-tight effect.

Another objective of the present invention is to provide a nail enamel applicator, wherein the tip of the pen head is clamped by the clamping hole of the adaptor tightly so that the clamping hole of the adaptor is sealed closely by the tip of the pen head without producing a gap between the tip of the pen head and the clamping hole of the adaptor to prevent the air from being introduced into the tube so as to keep the quality of the nail enamel in the tube.

A further objective of the present invention is to provide a nail enamel applicator, wherein the tip of the pen head is guided by the guide section of the top cap to align with the sealing aperture of the top cap so that the tip of the pen head is inserted into the sealing aperture of the top cap smoothly to prevent the tip of the pen head from being distorted or deformed during assembly.

A further objective of the present invention is to provide a nail enamel applicator, wherein the tip of the pen head is guided by the guide portion of the adaptor to align with the clamping hole of the adaptor so that the tip of the pen head is inserted into the clamping hole of the adaptor smoothly to prevent the tip of the pen head from being distorted or deformed during fabrication.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
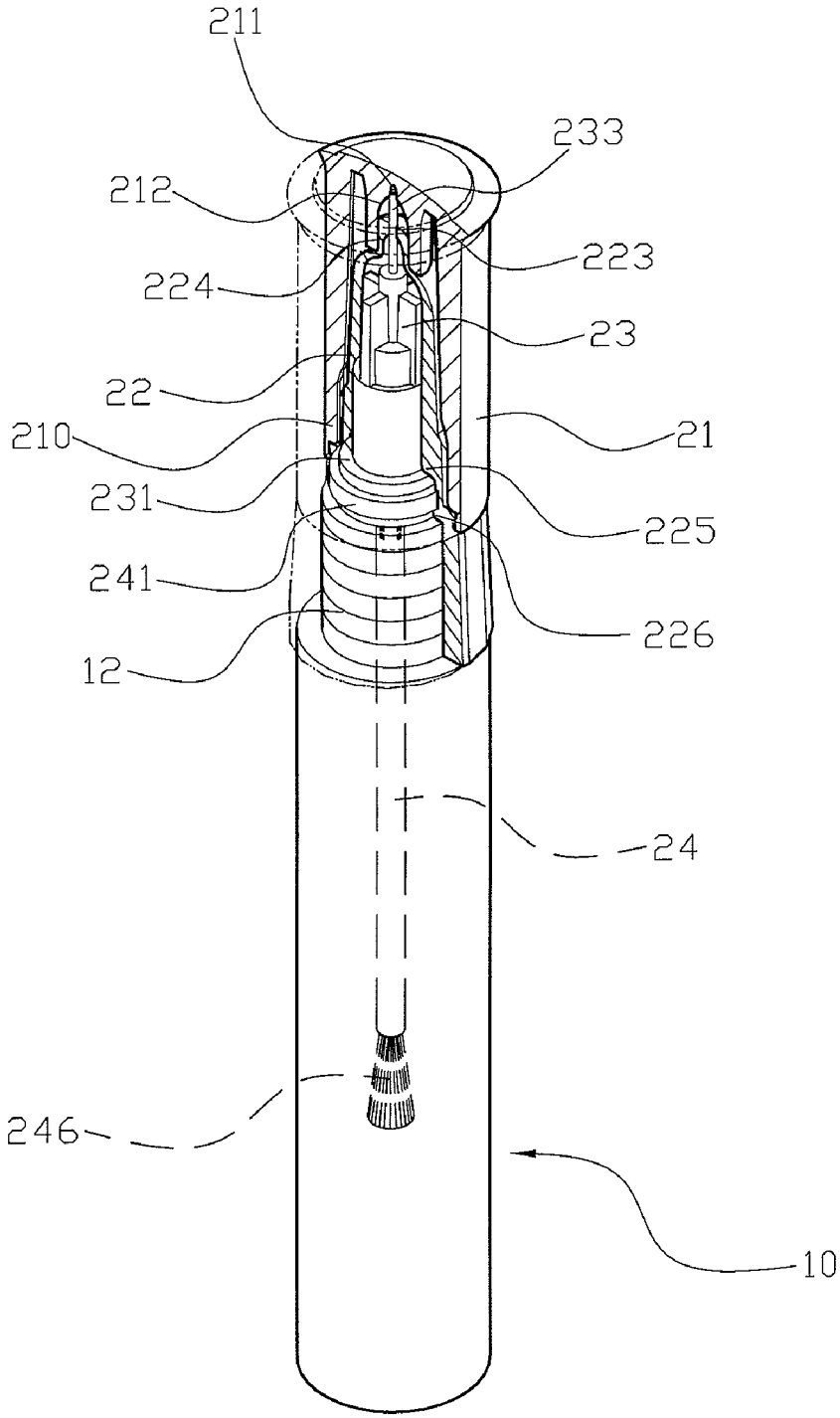
FIG. 1 is a partially perspective cross-sectional view of a nail enamel applicator in accordance with the preferred embodiment of the present invention.
Figure 2:
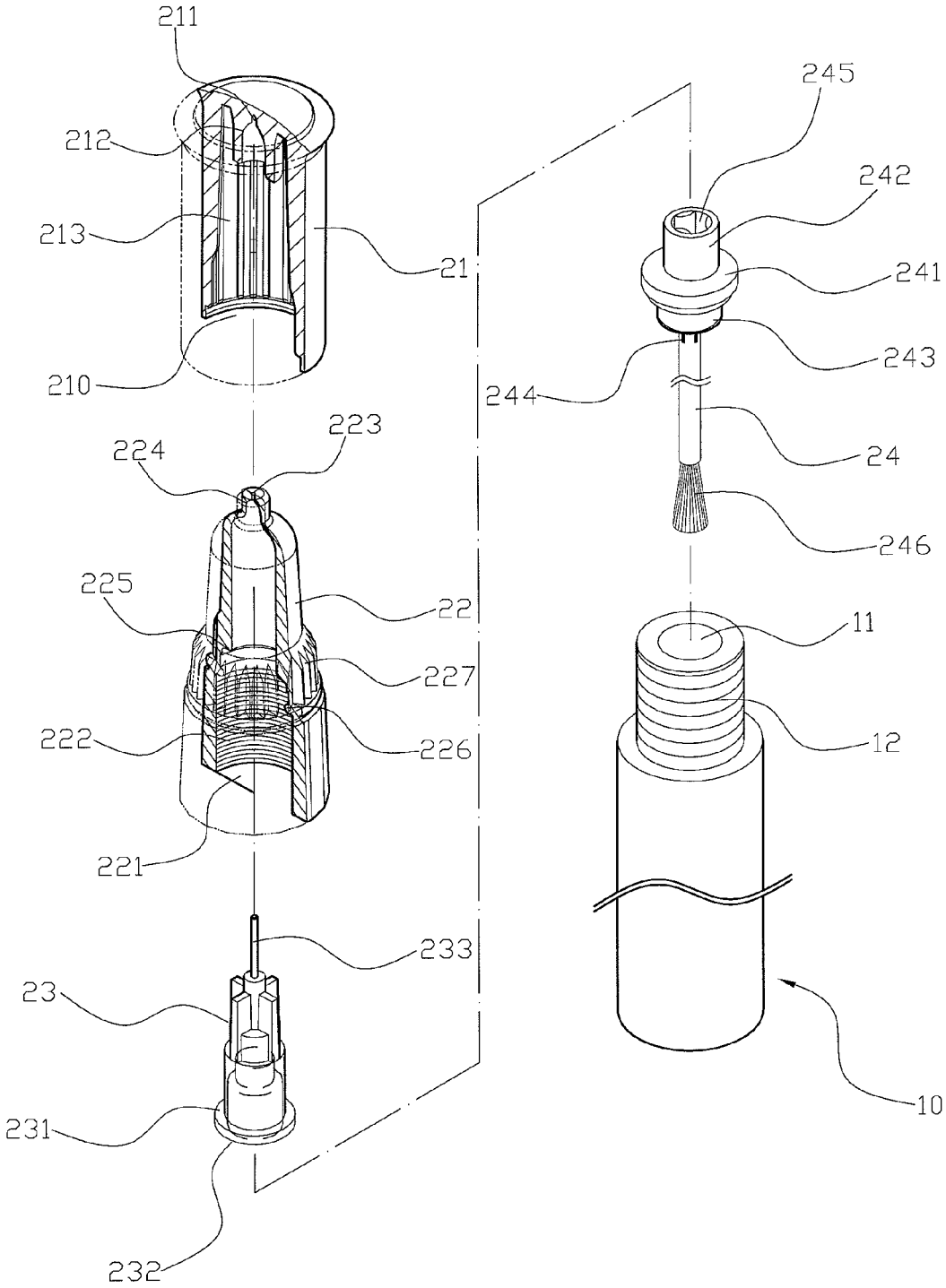
FIG. 2 is an exploded perspective view of the nail enamel applicator as shown in FIG. 1.
Figure 3:
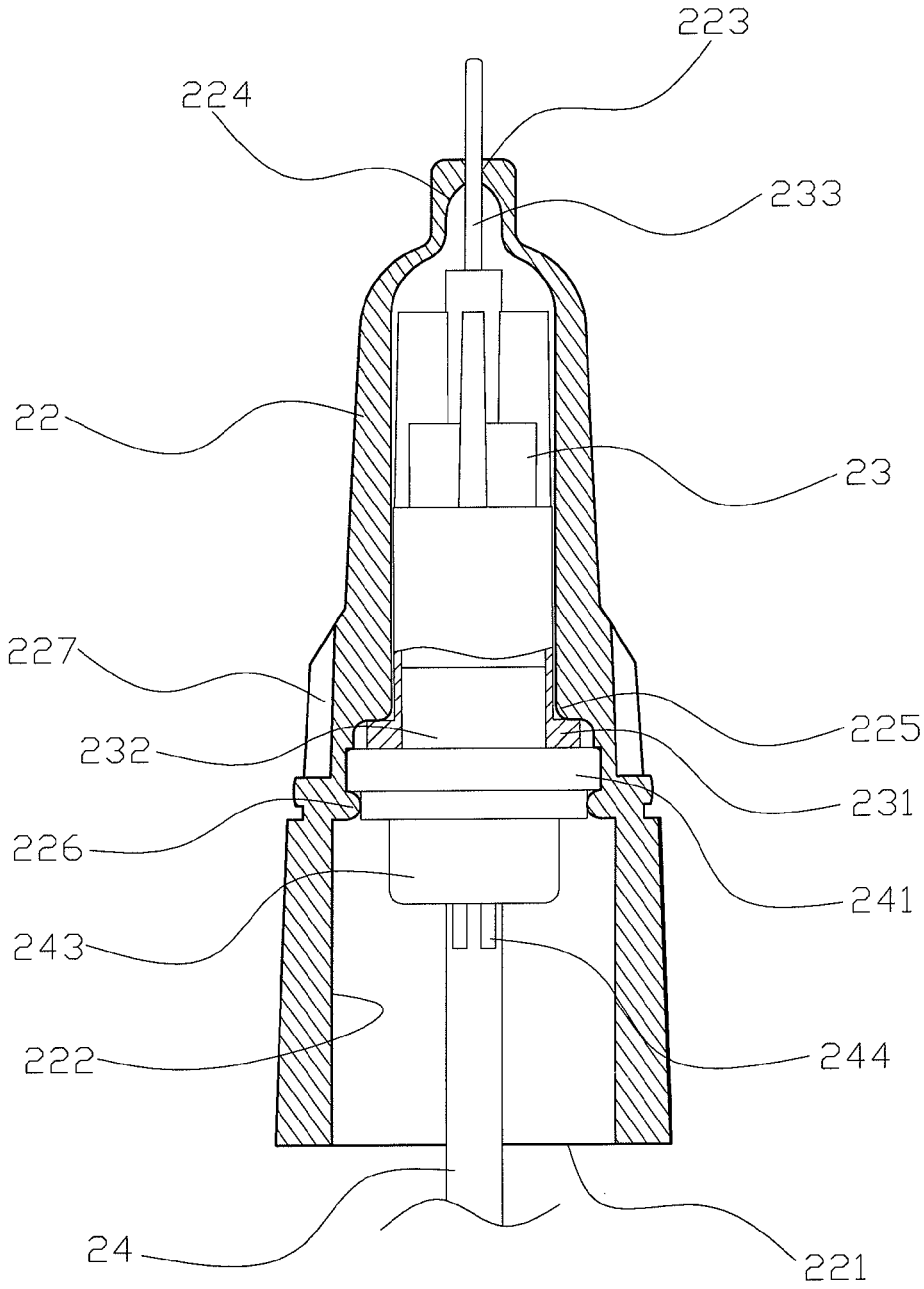
FIG. 3 is a partially cross-sectional view of the nail enamel applicator as shown in FIG. 1.

Referring to the drawings and initially to FIGS. 1-3, a nail enamel applicator in accordance with the preferred embodiment of the present invention comprises a resilient tube 10 having an open top portion 11, a hollow adaptor 22 having an open lower end 221 mounted on the top portion 11 of the tube 10 and an upper end provided with a clamping hole 223 and a guide portion 224, a hollow pen head 23 mounted in the adaptor 22 and having an upper end provided with a hollow tip 233 extending through the guide portion 224 into the clamping hole 223 of the adaptor 22 and protruding outwardly from the clamping hole 223 of the adaptor 22, a top cap 21 mounted on the adaptor 22 to cover the tip 233 of the pen head 23, and a brush 24 mounted in the adaptor 22 and having an upper end provided with a hollow pipe 242 inserted into an open lower end 232 of the pen head 23 and a lower end provided with multiple bristles 246 extending into the tube 10.

The tube 10 has an inside containing a nail enamel therein. The top portion 11 of the tube 10 has an outer wall provided with an outer thread 12.

The adaptor 22 has an inner wall provided with a stop shoulder 225 and a positioning rib 226. The stop shoulder 225 and the positioning rib 226 of the adaptor 22 are located between the guide portion 224 and the open lower end 221 of the adaptor 22. The open lower end 221 of the adaptor 22 has an inner portion provided with an inner thread 222 screwed onto the outer thread 12 of the tube 10 to lock the open lower end 221 of the adaptor 22 onto the top portion 11 of the tube 10. The guide portion 224 of the adaptor 22 is located under and connected to the clamping hole 223 of the adaptor 22 to guide movement of the tip 233 of the pen head 23 into the clamping hole 223 of the adaptor 22. The guide portion 224 of the adaptor 22 has a substantially arc-shaped cross-sectional profile and expands gradually from the clamping hole 223 toward the open lower end 221 of the adaptor 22. The adaptor 22 has an outer wall provided with an axially extending serrated portion 227.

The tip 233 of the pen head 23 is connected to an inside of the pen head 23. The tip 233 of the pen head 23 has a diameter greater than that of the clamping hole 223 of the adaptor 22 so that the tip 233 of the pen head 23 presses the clamping hole 223 of the adaptor 22 closely so as to seal the clamping hole 223 of the adaptor 22. The open lower end 232 of the pen head 23 is connected to the tip 233 of the pen head 23 and has an outer wall provided with a stop flange 231 abutting the stop shoulder 225 of the adaptor 22 to locate the pen head 23 in the adaptor 22.

The top cap 21 has an open lower end 210 mounted on the adaptor 22. The top cap 21 has an inner wall provided with an axially extending serrated section 213 engaging with the serrated portion 227 of the adaptor 22 to detachably lock the top cap 21 onto the adaptor 22. The top cap 21 has a top portion having an inner side provided with a sealing aperture 211 to allow insertion of the tip 233 of the pen head 23 and provided with a guide section 212 to guide the movement of the tip 233 of the pen head 23 into the sealing aperture 211. The guide section 212 of the top cap 21 is located under and connected to the sealing aperture 211 of the top cap 21. The guide section 212 of the top cap 21 has a substantially arc-shaped cross-sectional profile and expands gradually from the sealing aperture 211 of the top cap 21 toward the open lower end 210 of the top cap 21.

The upper end of the brush 24 is further provided with a positioning collar 241 located between the stop flange 231 of the pen head 23 and the positioning rib 226 of the adaptor 22 to locate the brush 24 in the adaptor 22. Thus, the stop flange 231 of the pen head 23 and the positioning collar 241 of the brush 24 are clamped between the stop shoulder 225 and the positioning rib 226 of the adaptor 22. The upper end of the brush 24 is further provided with a ring-shaped plug 243 inserted into the top portion 11 of the tube 10. The plug 243 of the brush 24 has a diameter greater than that of the top portion 11 of the tube 10. The positioning collar 241 of the brush 24 is located beneath the pipe 242 of the brush 24, and the plug 243 of the brush 24 is located beneath the positioning collar 241 of the brush 24. The pipe 242 of the brush 24 has a diameter flush with that of the open lower end 232 of the pen head 23 and has an inner portion provided with a conduit 245 connected to the tip 233 of the pen head 23. The brush 24 has a peripheral wall provided with a plurality of connecting holes 244 connected to the conduit 245 of the pipe 242.

Figure 4:
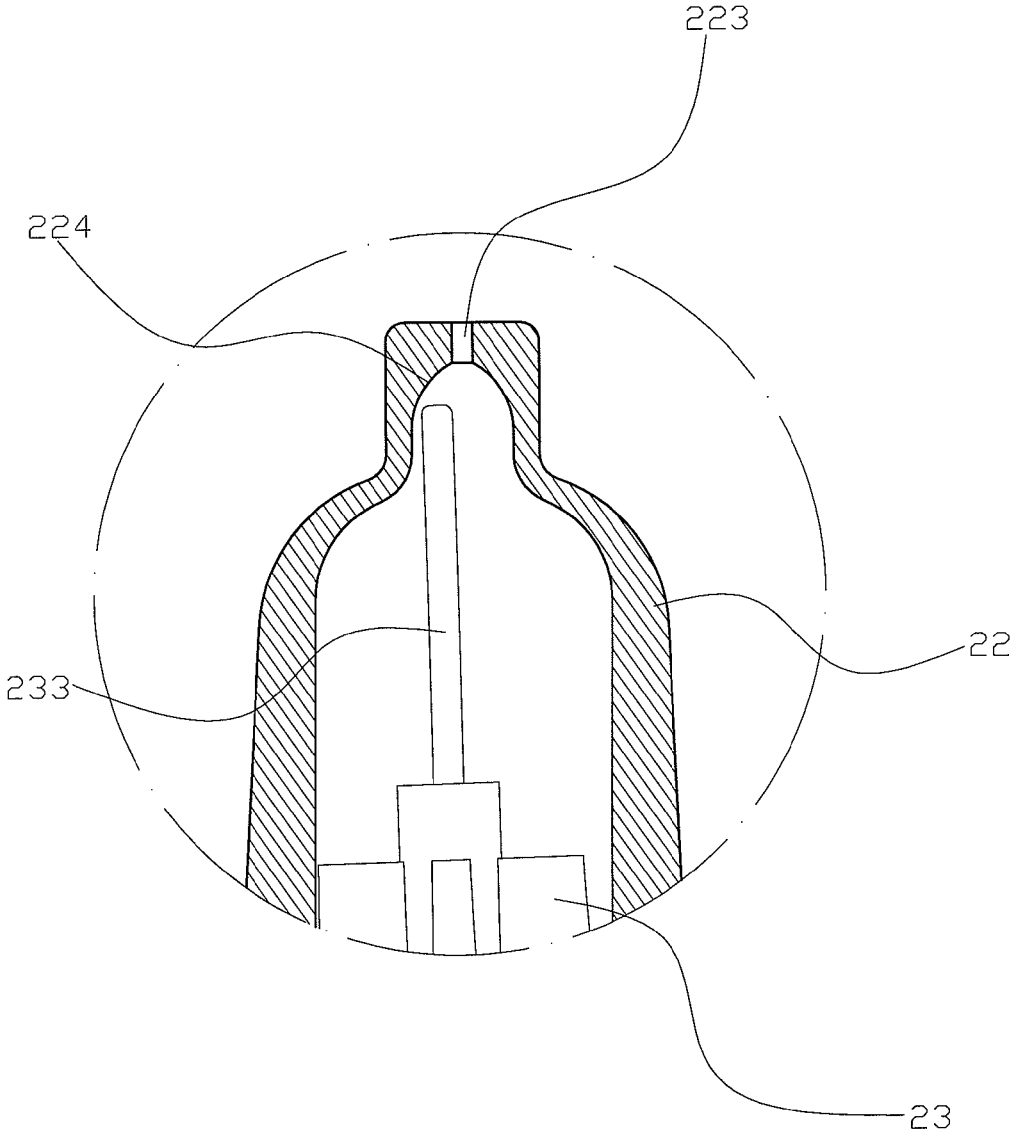
FIG. 4 is a partially cross-sectional view showing assembly of the nail enamel applicator as shown in FIG. 1.
Figure 5:
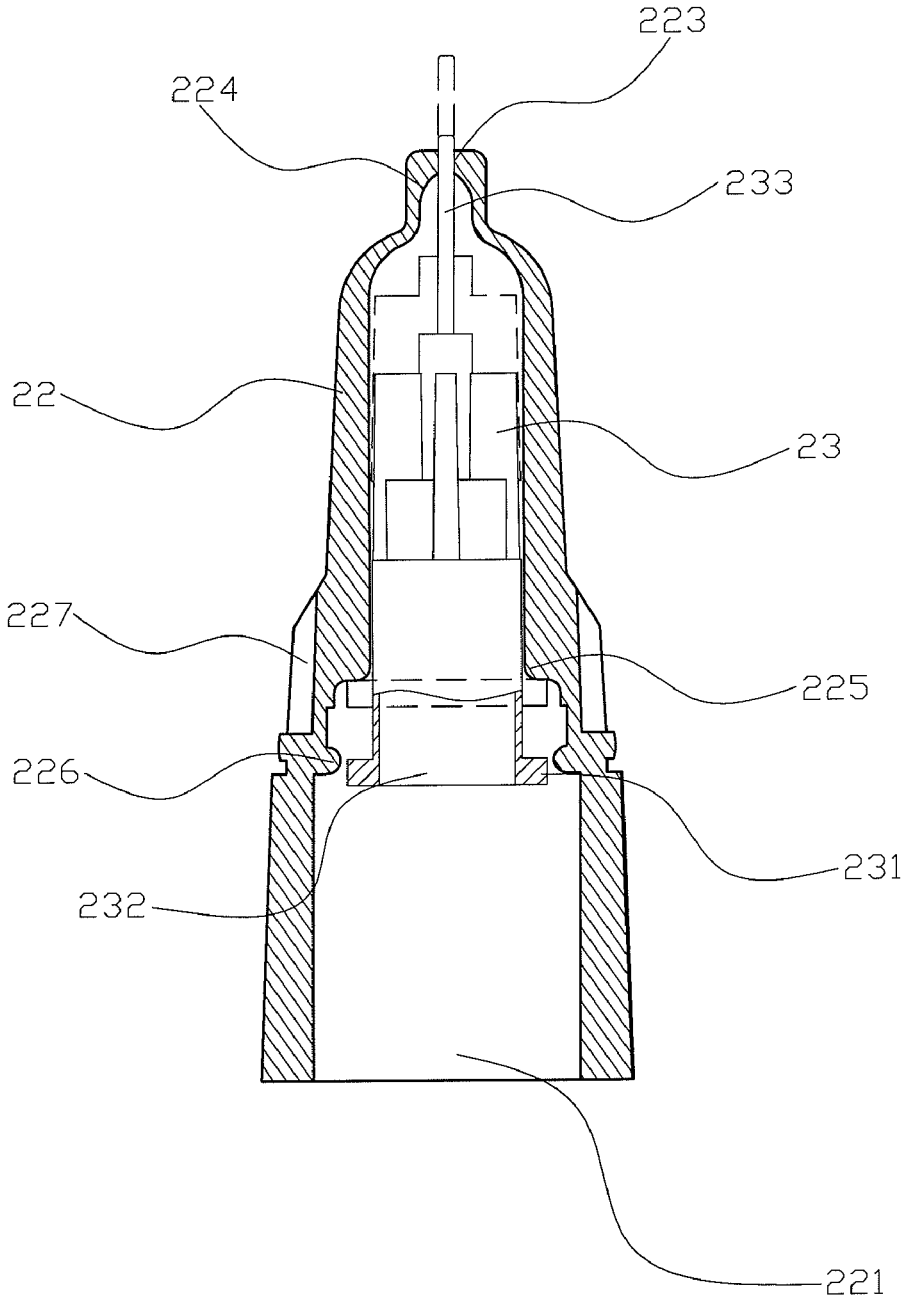
FIG. 5 is a partially cross-sectional view showing assembly of the nail enamel applicator as shown in FIG. 1.
Figure 6:
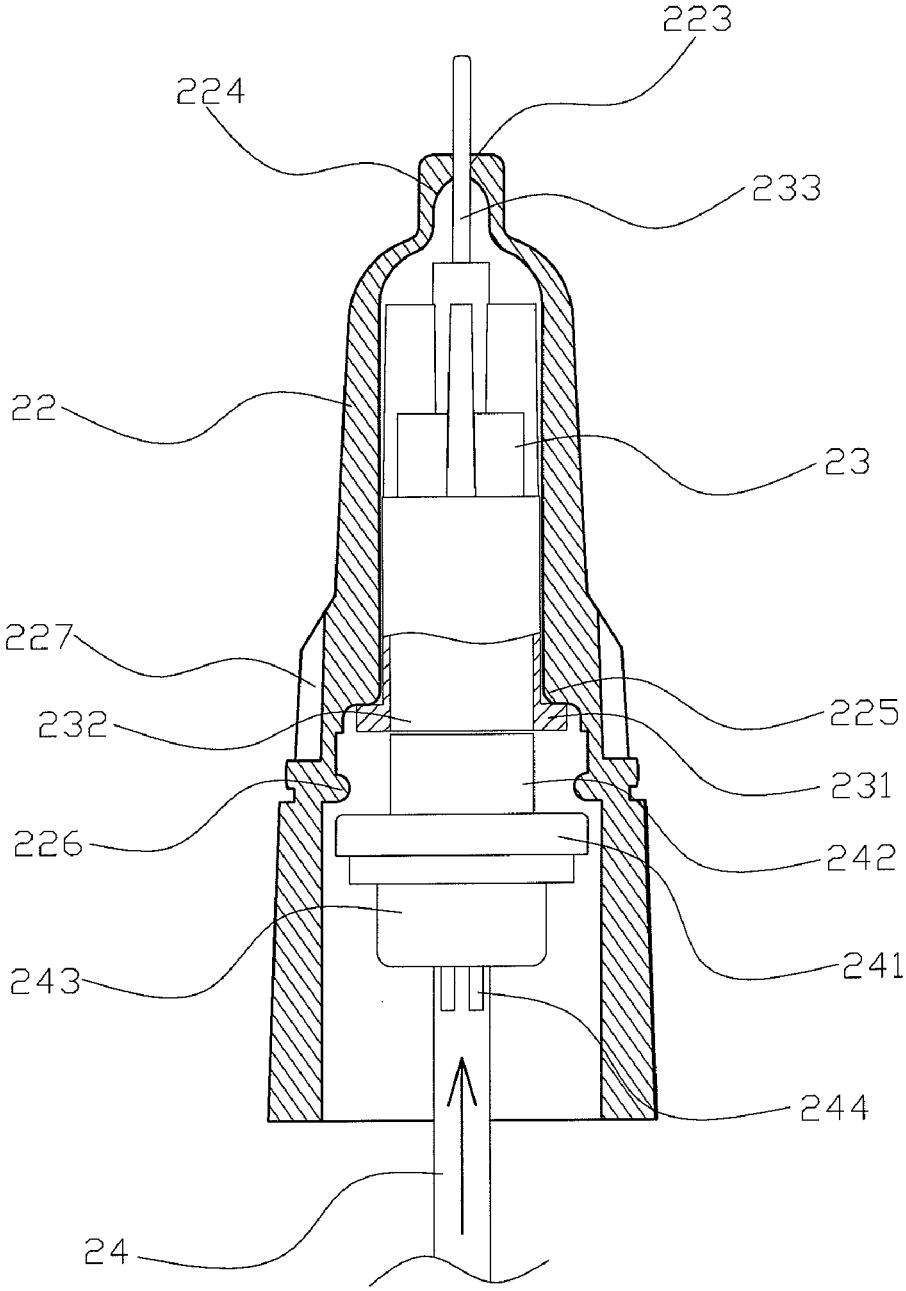
FIG. 6 is a partially cross-sectional view showing assembly of the nail enamel applicator as shown in FIG. 1.
Figure 7:
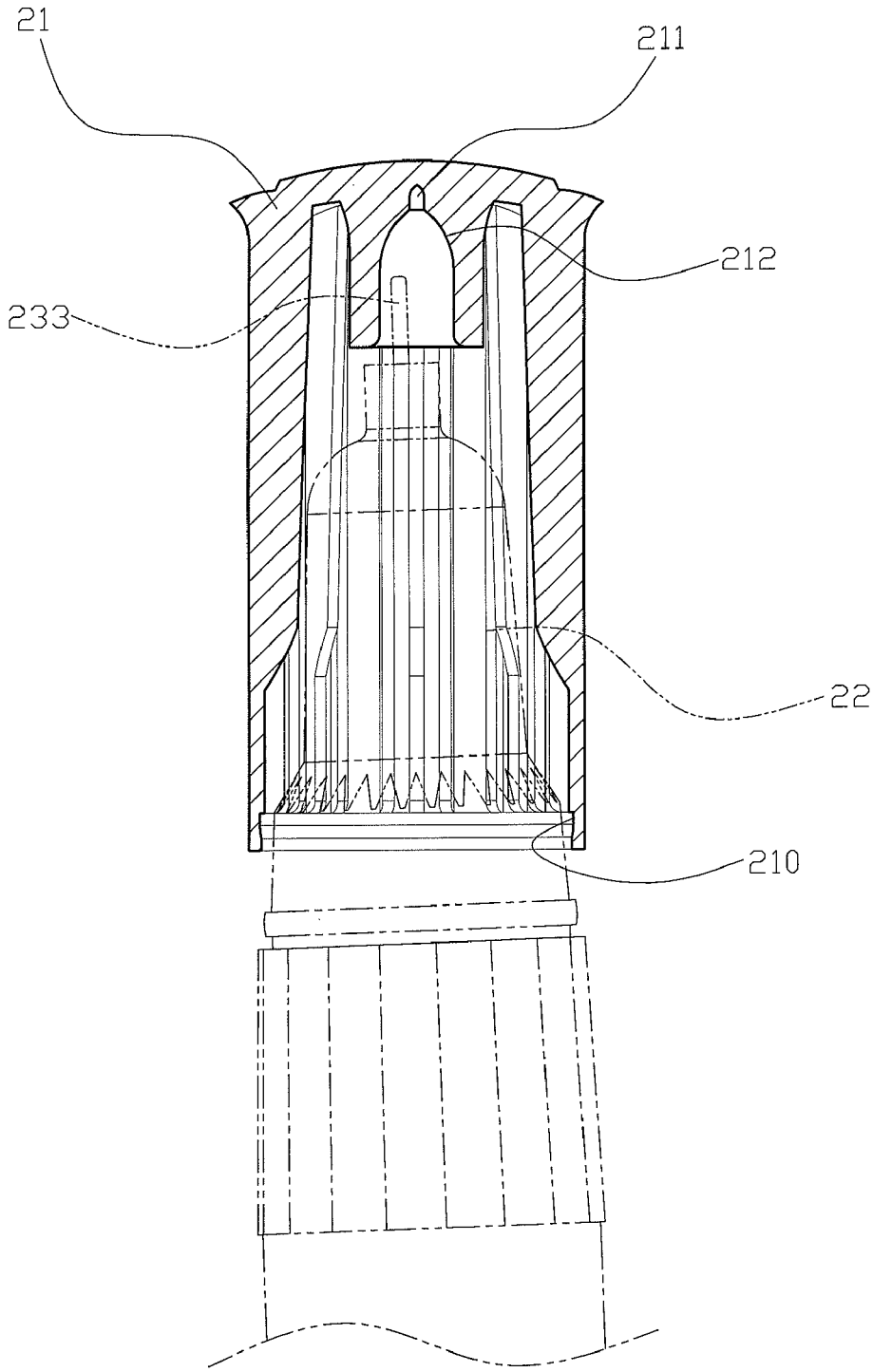
FIG. 7 is a partially cross-sectional view showing assembly of the nail enamel applicator as shown in FIG. 1.
Figure 8:
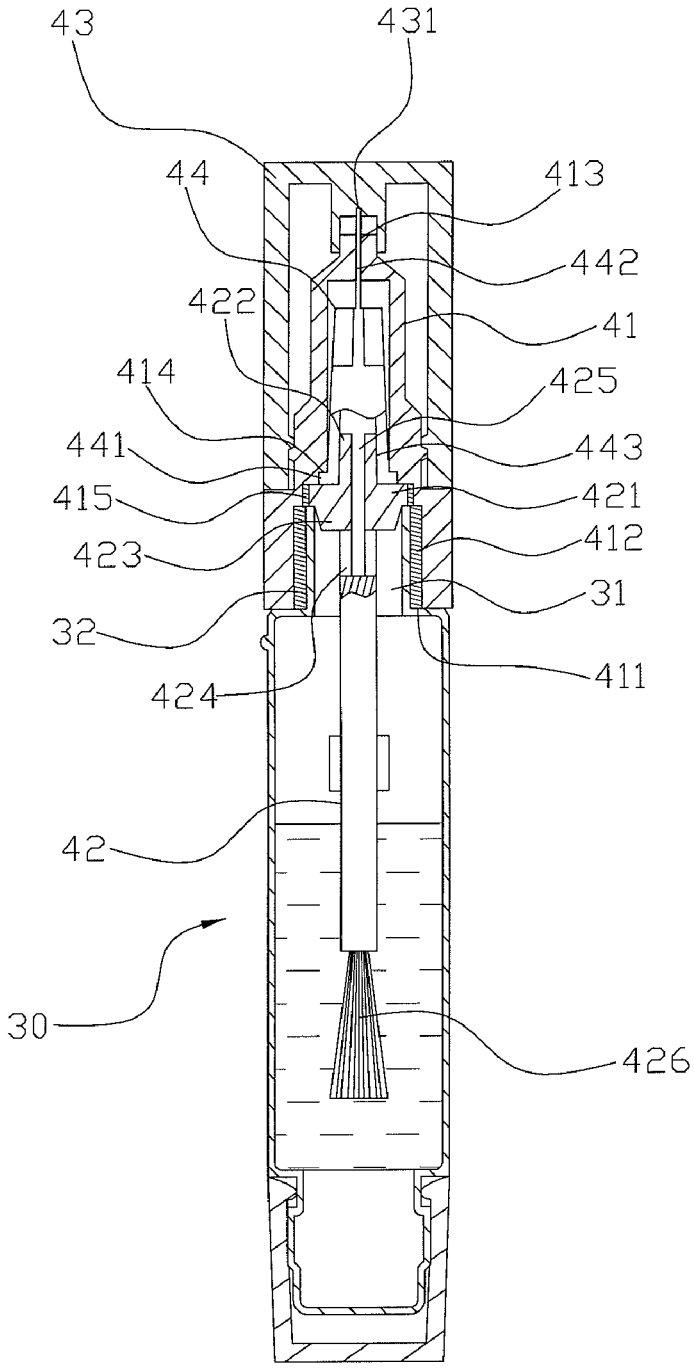
PRIOR ART FIG. 8
FIG. 8 is a front cross-sectional view of a conventional nail enamel applicator in accordance with the prior art.

In assembly, referring to FIGS. 3-7 with reference to FIGS. 1 and 2, when the pen head 23 is inserted into the adaptor 22, the tip 233 of the pen head 23 is guided by the guide portion 224 of the adaptor 22 as shown in FIG. 4 to align with the clamping hole 223 of the adaptor 22 so that the tip 233 of the pen head 23 is inserted into the clamping hole 223 of the adaptor 22 (by punching) easily and quickly as shown in FIG. 5. At this time, the stop flange 231 of the pen head 23 is stopped by the stop shoulder 225 of the adaptor 22. In such a manner, the adaptor 22 made of plastic material is expanded outwardly when the tip 233 of the pen head 23 is inserted through the clamping hole 223 of the adaptor 22 and is retracted inwardly after the tip 233 of the pen head 23 is inserted into the clamping hole 223 of the adaptor 22 by its resilience so that the tip 233 of the pen head 23 is clamped by the clamping hole 223 of the adaptor 22 tightly. Then, the pipe 242 of the brush 24 is inserted into the adaptor 22 and is directed toward the pen head 23 as shown in FIG. 6. Then, the positioning collar 241 of the brush 24 is forced to pass through the positioning rib 226 of the adaptor 22, and the pipe 242 of the brush 24 is inserted into an open lower end 232 of the pen head 23, so that the stop flange 231 of the pen head 23 and the positioning collar 241 of the brush 24 are clamped between the stop shoulder 225 and the positioning rib 226 of the adaptor 22 as shown in FIG. 3 to locate the pen head 23 and the brush 24 in the adaptor 22. Then, when the top cap 21 is mounted on the adaptor 22, the tip 233 of the pen head 23 is guided by the guide section 212 of the top cap 21 as shown in FIG. 7 to align with the sealing aperture 211 of the top cap 21 so that the tip 233 of the pen head 23 is inserted into the sealing aperture 211 of the top cap 21 easily and quickly. Finally, when the adaptor 22 is mounted on the top portion 11 of the tube 10, the plug 243 of the brush 24 is inserted into the top portion 11 of the tube 10 to seal the top portion 11 of the tube 10.

In operation, referring to FIGS. 1-3, after the adaptor 22 is removed from the top portion 11 of the tube 10, the brush 24 is detached from the top portion 11 of the tube 10, so that the nail enamel on the bristles 246 of the brush 24 can be used to paint a user's nails in a planar manner. Alternatively, after the top cap 21 is removed from the adaptor 22, the tip 233 of the pen head 23 is exposed outwardly from the clamping hole 223 of the adaptor 22. In such a manner, when the tube 10 is squeezed by the user, the nail enamel in the tube 10 is forced to pass through the connecting holes 244 of the brush 24, the conduit 245 of the pipe 242 and the inside of the pen head 23 into the tip 233 of the pen head 23 and is sprayed outwardly from the tip 233 of the pen head 23 to paint the user's nails in a linear manner.

Accordingly, the tip 233 of the pen head 23 is clamped by the clamping hole 223 of the adaptor 22 tightly so that the clamping hole 223 of the adaptor 22 is sealed closely by the tip 233 of the pen head 23 without producing a gap between the tip 233 of the pen head 23 and the clamping hole 223 of the adaptor 22 to prevent the air from being introduced into the tube 10 so as to keep the quality of the nail enamel in the tube 10. In addition, the tip 233 of the pen head 23 is guided by the guide section 212 of the top cap 21 to align with the sealing aperture 211 of the top cap 21 so that the tip 233 of the pen head 23 is inserted into the sealing aperture 211 of the top cap 21 smoothly to prevent the tip 233 of the pen head 23 from being distorted or deformed during assembly. Further, the tip 233 of the pen head 23 is guided by the guide portion 224 of the adaptor 22 to align with the clamping hole 223 of the adaptor 22 so that the tip 233 of the pen head 23 is inserted into the clamping hole 223 of the adaptor 22 smoothly to prevent the tip 233 of the pen head 23 from being distorted or deformed during fabrication.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A nail enamel applicator, comprising:

a resilient tube having an open top portion;

a hollow adaptor having an open lower end mounted on the top portion of the tube and an upper end provided with a clamping hole and a guide portion;

a hollow pen head mounted in the adaptor and having an upper end provided with a hollow tip extending through the guide portion into the clamping hole of the adaptor and protruding outwardly from the clamping hole of the adaptor;

a top cap mounted on the adaptor to cover the tip of the pen head;

a brush mounted in the adaptor and having an upper end provided with a hollow pipe inserted into an open lower end of the pen head and a lower end provided with multiple bristles extending into the tube;

wherein the tip of the pen head has a diameter greater than that of the clamping hole of the adaptor;

the tip of the pen head presses the clamping hole of the adaptor closely to seal the clamping hole of the adaptor;

the guide portion of the adaptor is located under and connected to the clamping hole of the adaptor to guide movement of the tip of the pen head into the clamping hole of the adaptor;

the guide portion of the adaptor expands gradually from the clamping hole toward the open lower end of the adaptor;

the top cap has a top portion having an inner side provided with a sealing aperture to allow insertion of the tip of the pen head and provided with a guide section to guide the movement of the tip of the pen head into the sealing aperture;

the guide section of the top cap is located under and connected to the sealing aperture of the top cap;

the top cap has an open lower end mounted on the adaptor;

the guide section of the top cap expands gradually from the sealing aperture of the top cap toward the open lower end of the top cap.

2. The nail enamel applicator of claim 1, wherein the guide portion of the adaptor has a substantially arc-shaped cross-sectional profile.

3. The nail enamel applicator of claim 1, wherein the guide section of the top cap has a substantially arc-shaped cross-sectional profile.

4. The nail enamel applicator of claim 1, wherein the adaptor has an outer wall provided with an axially extending serrated portion;

the top cap has an inner wall provided with an axially extending serrated section engaging with the serrated portion of the adaptor to detachably lock the top cap onto the adaptor.

5. The nail enamel applicator of claim 1, wherein the adaptor has an inner wall provided with a stop shoulder and a positioning rib;

the open lower end of the pen head has an outer wall provided with a stop flange abutting the stop shoulder of the adaptor to locate the pen head in the adaptor;

the upper end of the brush is further provided with a positioning collar located between the stop flange of the pen head and the positioning rib of the adaptor to locate the brush in the adaptor.

6. The nail enamel applicator of claim 5, wherein the stop flange of the pen head and the positioning collar of the brush are clamped between the stop shoulder and the positioning rib of the adaptor.

7. The nail enamel applicator of claim 5, wherein the upper end of the brush is further provided with a ring-shaped plug inserted into the top portion of the tube;

the plug of the brush has a diameter greater than that of the top portion of the tube.

8. The nail enamel applicator of claim 5, wherein the stop shoulder and the positioning rib of the adaptor are located between the guide portion and the open lower end of the adaptor.

9. The nail enamel applicator of claim 7, wherein the positioning collar of the brush is located beneath the pipe of the brush;

the plug of the brush is located beneath the positioning collar of the brush.

10. The nail enamel applicator of claim 1, wherein the pipe of the brush has a diameter flush with that of the open lower end of the pen head.

* * * * *